US005174535A

United States Patent [19]

Stubbersfield

[11] Patent Number: 5,174,535

[45] Date of Patent: Dec. 29, 1992

[54] CROSS-ARM MOUNTING BRACKET FOR POLES

[75] Inventor: Edgar M. Stubbersfield, Gatton, Australia

[73] Assignee: Vanbrace Pty. Ltd., Gatton, Australia

[21] Appl. No.: 671,898

[22] PCT Filed: May 18, 1990

[86] PCT No.: PCT/AU90/00201

§ 371 Date: Apr. 2, 1991

§ 102(e) Date: Apr. 2, 1991

[87] PCT Pub. No.: WO90/14481

PCT Pub. Date: Nov. 29, 1990

[30] Foreign Application Priority Data

May 18, 1989 [AU] Australia ..... PJ4212
Mar. 1, 1990 [AU] Australia ..... PJ8870

[51] Int. Cl.[5] ..... A47G 1/10
[52] U.S. Cl. ..... 248/316.1; 248/218.4
[58] Field of Search ..... 248/316.1, 216.1, 300, 248/309.1, 218.4, 264; 174/45 R, 164; 52/40; 211/105.1, 123, 94

[56] References Cited

U.S. PATENT DOCUMENTS

| | | | |
|---|---|---|---|
| 950,859 | 3/1910 | Michaud | 211/94 |
| 1,956,340 | 4/1934 | Bernhardt | 211/123 |
| 2,024,892 | 12/1935 | Soper | 211/123 |
| 2,443,149 | 6/1948 | Rundell | 248/264 |
| 2,592,057 | 4/1952 | Murphy . | |

FOREIGN PATENT DOCUMENTS 124239 5/1947 Australia .

*Primary Examiner*—Blair M. Johnson
*Attorney, Agent, or Firm*—Kimmel, Crowell & Weaver

[57] ABSTRACT

The cross-arms (10) for electricity or telephone lines (13) are mounted on poles (11) by mounting brackets (12) so that the upper faces (17, 18) of the cross-arms (10) are inclined downwardly at approximately 45° to the horizontal. The lines (13) are carried by insulators (14) whose bases (15) are bolted, screwed or clamped to the cross-arm (10). The cross-arms (10) are supported in substantially V-shaped cradles mounted on, or formed integrally with base plates fixed to the poles (11).

17 Claims, 11 Drawing Sheets

CROSS-ARM MOUNTING BRACKET FOR POLES

BACKGROUND OF THE INVENTION

1. Field of the Invention

This Invention relates to a cross-arm mounting bracket for poles The invention is applicable to the mounting of cross-arms on electricity or telephone poles or the like.

2. PRIOR ART

Each year there are many disruptions to electricity supply due to the failure of the cross-arms on electricity poles. The cross-arms are subject to great extremes of temperature (e.g. from −30° C. to +60° C.); extremely high solar radiation; rainfall; high winds; humidity changes (from 10–100% which causes the timber to swell and shrink generating internal stresses); and industrial pollution and salt spray settling; on the arms, which attacks the timber.

To these atmospheric conditions must be added the weaknesses induced in the cross-arms by the holes drilled therein to receive the king bolts mounting the cross-arms to the posts; the holes for the diagonal braces; and the holes for the insulators. Not only do these holes reduce the effective dimensions of the cross-arms but they are also liable to rot and decay, which increases their size and reduces the cross-arm strength. Movement of the insulator pins in their holes, especially as the timber shrinks, further increases the problem.

SUMMARY OF THE INVENTION

Observation has shown that the top surface of the cross-arm is subject to much greater decay than the sides, due to the great exposure time to the sun and the settling of water/industrial pollution/salt thereon, which all attack the top surface. This greater decay could be alleviated if the cross-arms did not have a horizontal surface and so it is proposed that the cross-arms be mounted horizontally on the poles where the upper surfaces of the cross-arms are diagonally (or downwardly) inclined. Each time it rains, the water will simply run off, washing the cross-arms clean, instead of pooling on the top surface and settling in the cracks where fungal decay is encouraged by the collected pollutants. (If the cross-arms can be aligned North-South, they will receive less solar radiation).

The insulators may be fixed to the cross-arms by a bolt passing through the diagonal of the arm, with an angled cover over the bolt hole, or by a clamp around the arm to avoid drilling the cross-arms. Specialized insulators may be mounted via specialized brackets.

It is an object of the present invention to provide a mounting bracket for cross-arms for poles where the cross-arms are mounted horizontally on the poles with their faces diagonally inclined.

It is a preferred object to provide an improved method for mounting the insulators which reduces, or eliminates, the problem of rot or decay around the mounting of the insulators on the cross-arms.

Other preferred objects of the present invention will become apparent from the following description.

In one aspect, the present invention resides in a mounting bracket for cross-arms for poles including:

a substantially vertical base plate mountable on the pole by fastening means;

a substantially V-shaped cradle mounted on, or on the front of, the base plate to receive and support the cross-arm so that the faces of the cross-arm are diagonally inclined; and means on the cradle to receive fastening means to secure the cross-arm in the cradle.

The base plate may have a curved back, or have a planar back with rearwardly directed side flanges, to locate it on the post and the base plate is preferably secured to the pole by at least a single bolt adjacent the upper end of the base plate. Additional bolts may be used if preferred.

Preferably, the cradle extends transversely, horizontally at, or adjacent to, the lower end of the base plate so that diagonal braces between the cross-arm and the post are not required.

Where the cross-arms are to be mounted on the top of the poles, or on extensions from the top of the poles, the cradle preferably extends transversely, horizontally at, or adjacent to, the upper end of the base plate and a pair of such mounting brackets may be provided, diagonally opposed on the pole, for each cross-arm.

The cross-arms may be secured in the cradle by a pair of straps passing over the cross-arm and attached at each end to the cradle or by bolts, screws or studs passing through the forward and/or the rearward walls of the cradle.

In a second aspect, the present invention resides in insulator mountings for cross-arms mounted on the brackets hereinbefore described.

The insulators may be mounted on the cross-arm by:

a clamp around the cross-arm; or a bolt diagonally through the cross-arm, the bolt having an inverted V-shaped cap which covers the bolt holes and engages the downwardly inclined top faces of the cross-arm; or by a bolt, screw or stud passing through one of the walls of an inverted V-shaped cap or plate which engages the downwardly inclined top faces of the cross-arm.

The insulators may extend vertically or horizontally above or below the cross-arm, or horizontally from the ends thereof.

In a third aspect, the present invention resides in a combination of the cross-arm, brackets and insulators as hereinbefore described.

BRIEF DESCRIPTION OF THE DRAWINGS

To enable the invention to be fully understood, a number of preferred embodiments will now be described with reference to the accompanying drawings, in which.

DETAILED DESCRIPTION OF THE PREFERRED EMBODIMENTS

Figure 1:
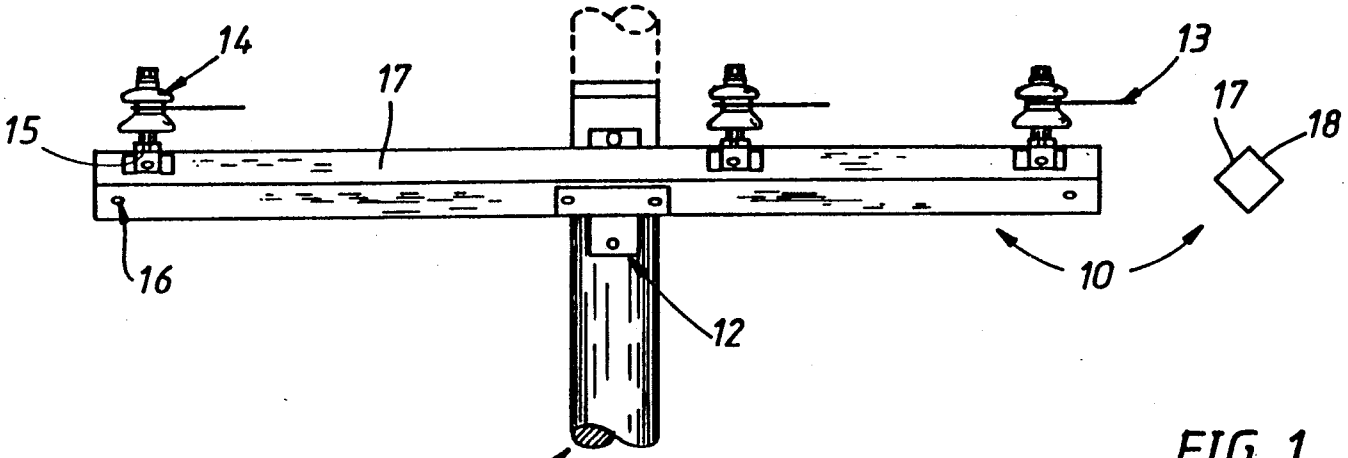
FIGS. 1 and 2 are respective front elevational and top plan views of a typical installation of a cross-arm (with standard pin-type insulators) as a wooden pole in accordance with the present invention.
Figure 2:
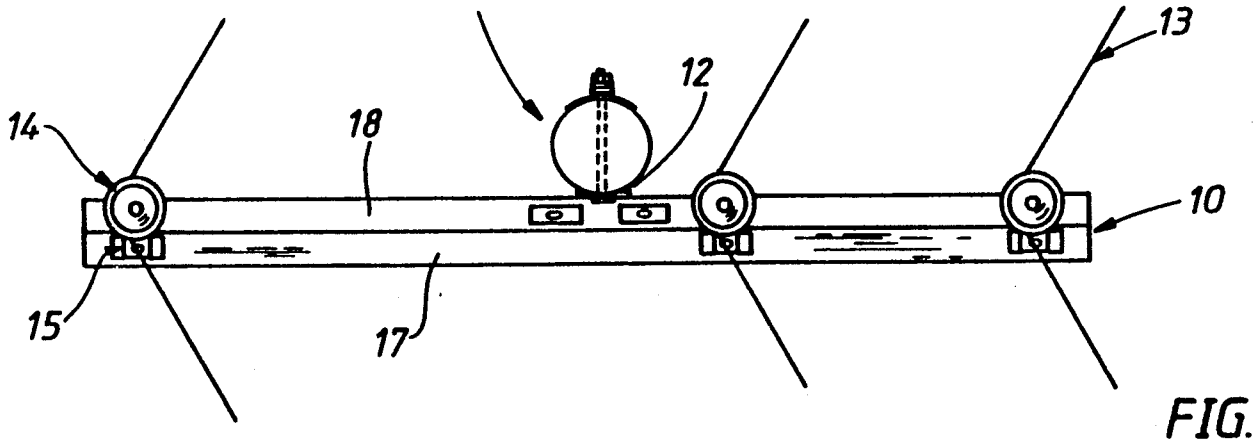

FIGS. 1 and 2 are respective front elevation and top plan views of a cross-arm installation for an 11 KV electricity line, where the cross-arm is amounted in accordance with the present invention. The cross-arm 10 is mounted adjacent the top of the wooden pole 11 via a mounting bracket 12, embodiments of which are to be hereinafter described, and the electrical wires 13 are supported via insulators 14 which have bases 15 fixed to the cross-arm 10. (Diagonal bolts 16 may pass through the ends of the cross-arm 10 to oppose any splitting of the ends of the cross-arm).

As is clearly indicated in the side elevational view in FIG. 1, the cross-arm 10 is supported by the mounting bracket 12 so that its upper faces 17, 18 are diagonally downwardly inclined (i.e. the faces 17, 18 be at 45° to the horizontal). Any rain which falls on the cross-arm 10 will run off the upper faces 17, 18 thereof (and not pool thereon) and will wash off any pollutants (or salts) which may have become deposited on those faces.

Figure 4:
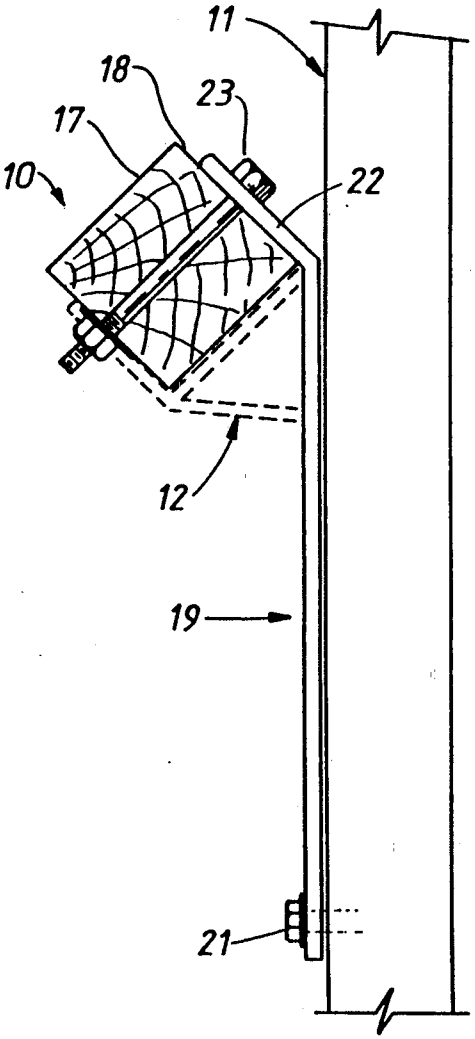
FIGS. 3 and 4 are respective front and side elevation views of a diagonal bracing strap for the cross arm.
Figure 3:
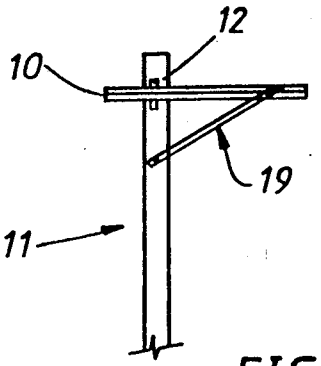
Figure 5:
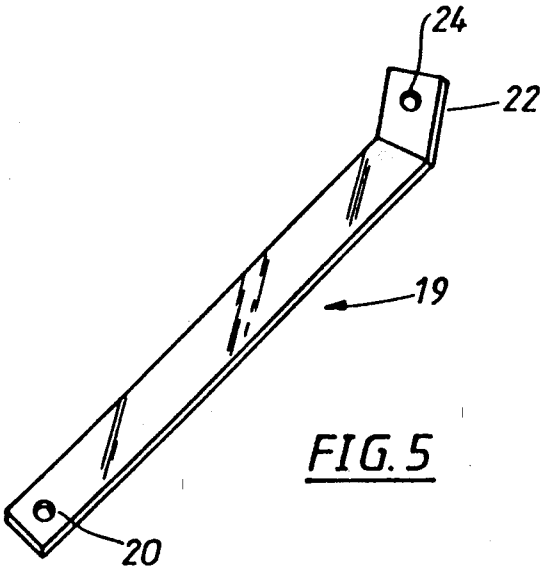
FIG. 5 is an isometric view of the bracing strap.

Referring now to FIGS. 3 to 5, electricity authorities may require the provision of a diagonal bracing strap 19 for the cross-arm 10. A hole 20 at the lower end of the strap 19 enables it to be secured to the pole 11 by a bolt 21, while the upper end 22 of the strap 19 is bent so that it overlies, and is fixed to the upper face 18 of the cross-arm 10, by a bolt 23 passing through a hole 24 in the strap. Alternatively, the bracing strap may be bent so that the upper end bolts to the underside of the cross-arm 10.

Preferred embodiments of the mounting brackets 12 for the cross-arm 10, and the insulators 14 mounted on the cross-arm 10, will now be described in detail.

Figure 6:
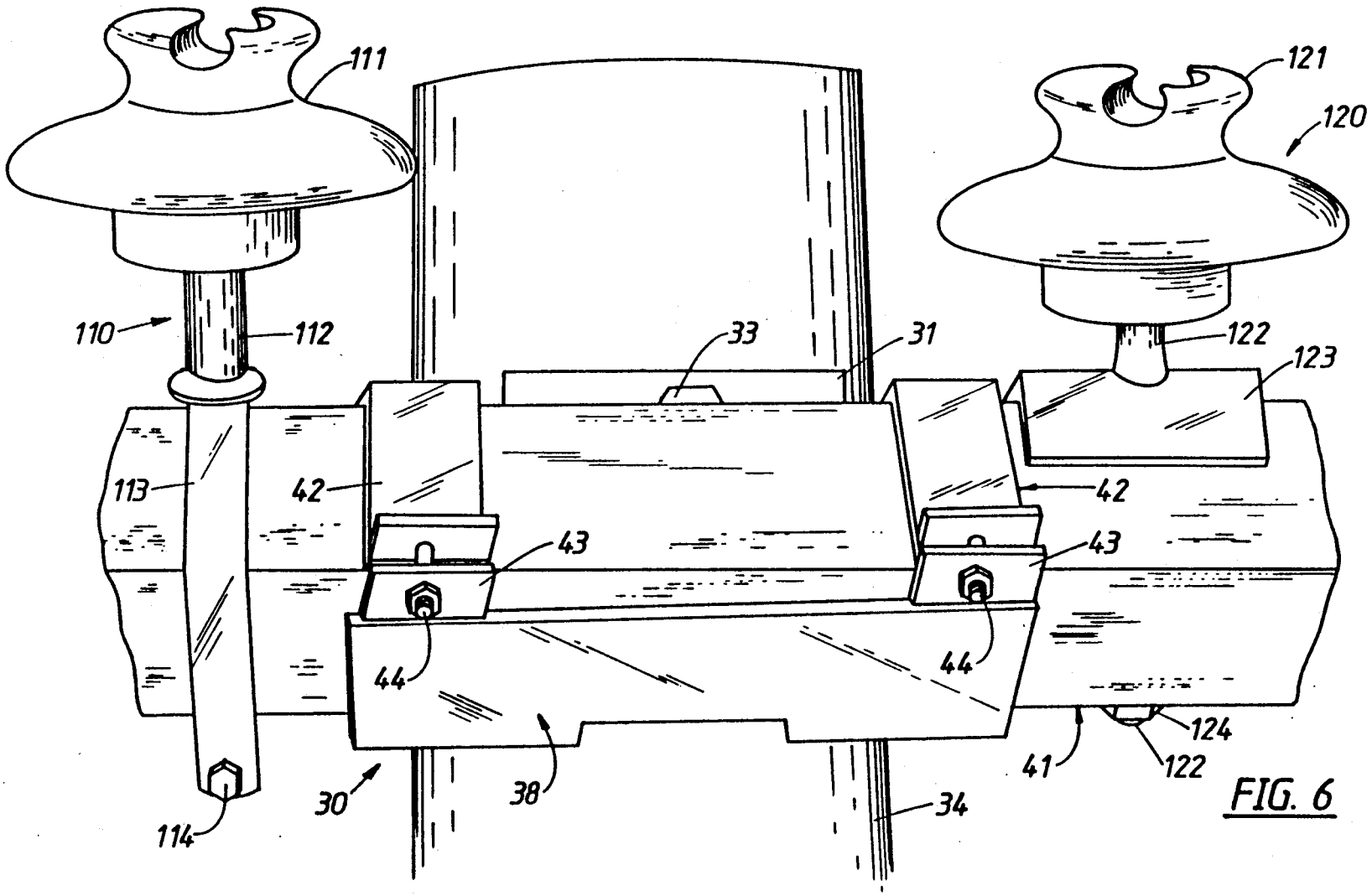
FIG. 6 is a front elevational view showing a cross-arm fixed to an electricity pole by a first embodiment of the mounting bracket, and slowing two alternative embodiments of the insulators.
Figure 7:
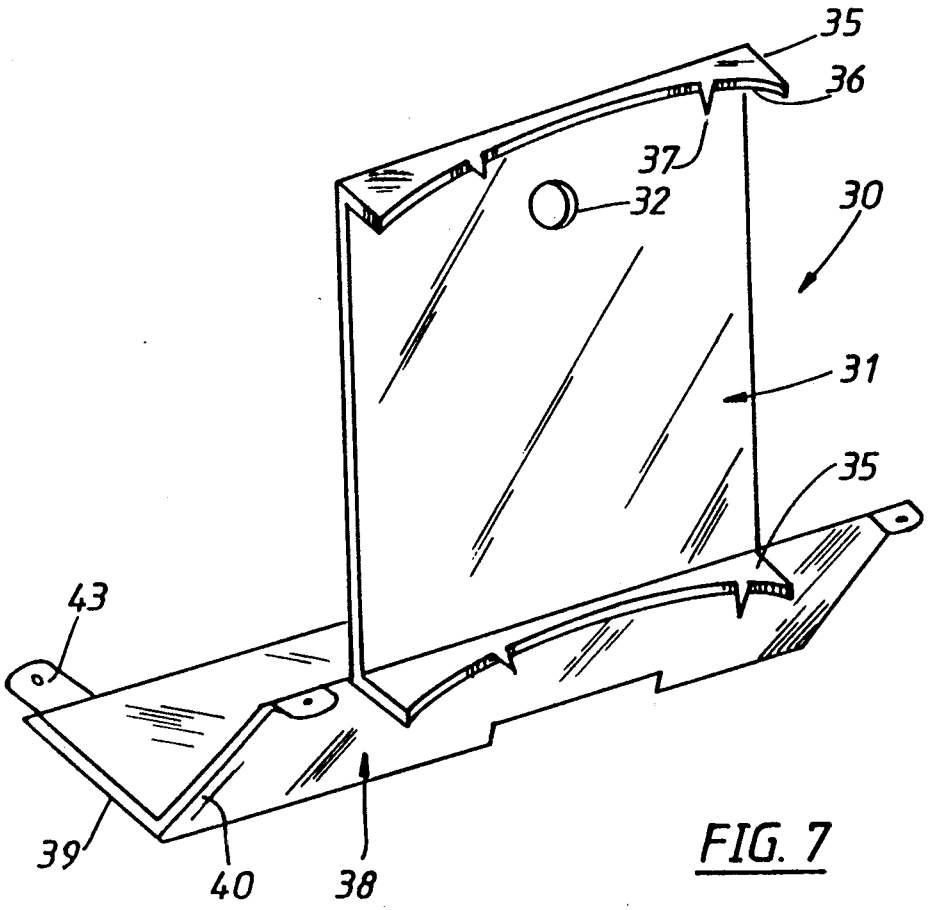
FIG. 7 is a rear elevational view of the mounting bracket of FIG. 6.

Referring to FIGS. 6 and 7, the mounting bracket 30 has a vertical base plate 31 with a hole 32 to receive a bolt 33 to secure the mounting bracket to the pole 34. A pair of rearwardly directed flanges 35 have curved rear faces 36 and teeth 37 to locate the bracket 30 on the pole 34.

A substantially V-shaped cradle 38 is fixed to the bottom of the base plate 31, with downwardly inclined front and rear walls 39, 40. The cradle supports the cross-arm 41 and the latter is secured by a pair of clamping straps 42 which are bolted to lugs or tabs 43, on the cradle 38, by bolts 44. This arrangement avoids the necessity for diagonal braces or for drilling holes in the cross-arm 41 which may weaken the latter.

Figure 8:
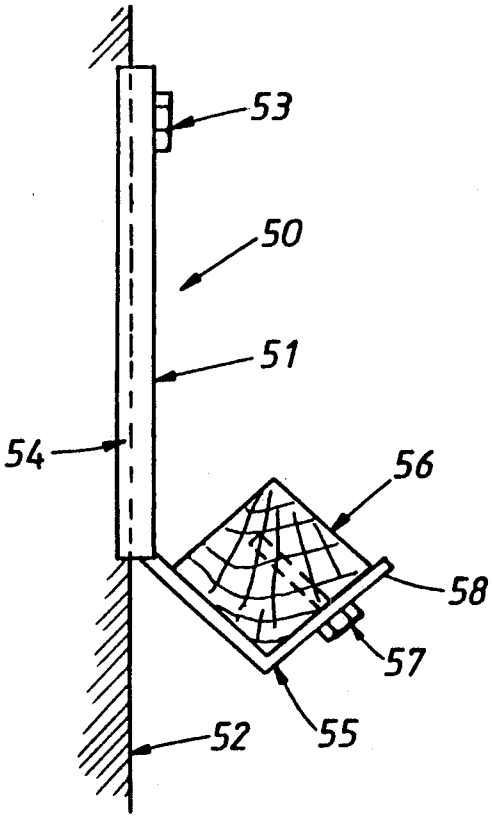
FIG. 8 is a side elevational view of a second embodiment of the mounting bracket.

Referring now to FIG. 8, in a second embodiment of the mounting bracket 50 has a planar base plate 51 fixed to the pole 52 by a bolt 53, and rearwardly directed side flanges 54 bear against the pole 52 provide stability. A V-shaped cradle 55 is welded to the base of the base plate 51 and the cross-arm 56 is secured in the cradle 55 by a coach screw 57 (or bolt) through the front wall 58 of the cradle 55.

Figure 9:
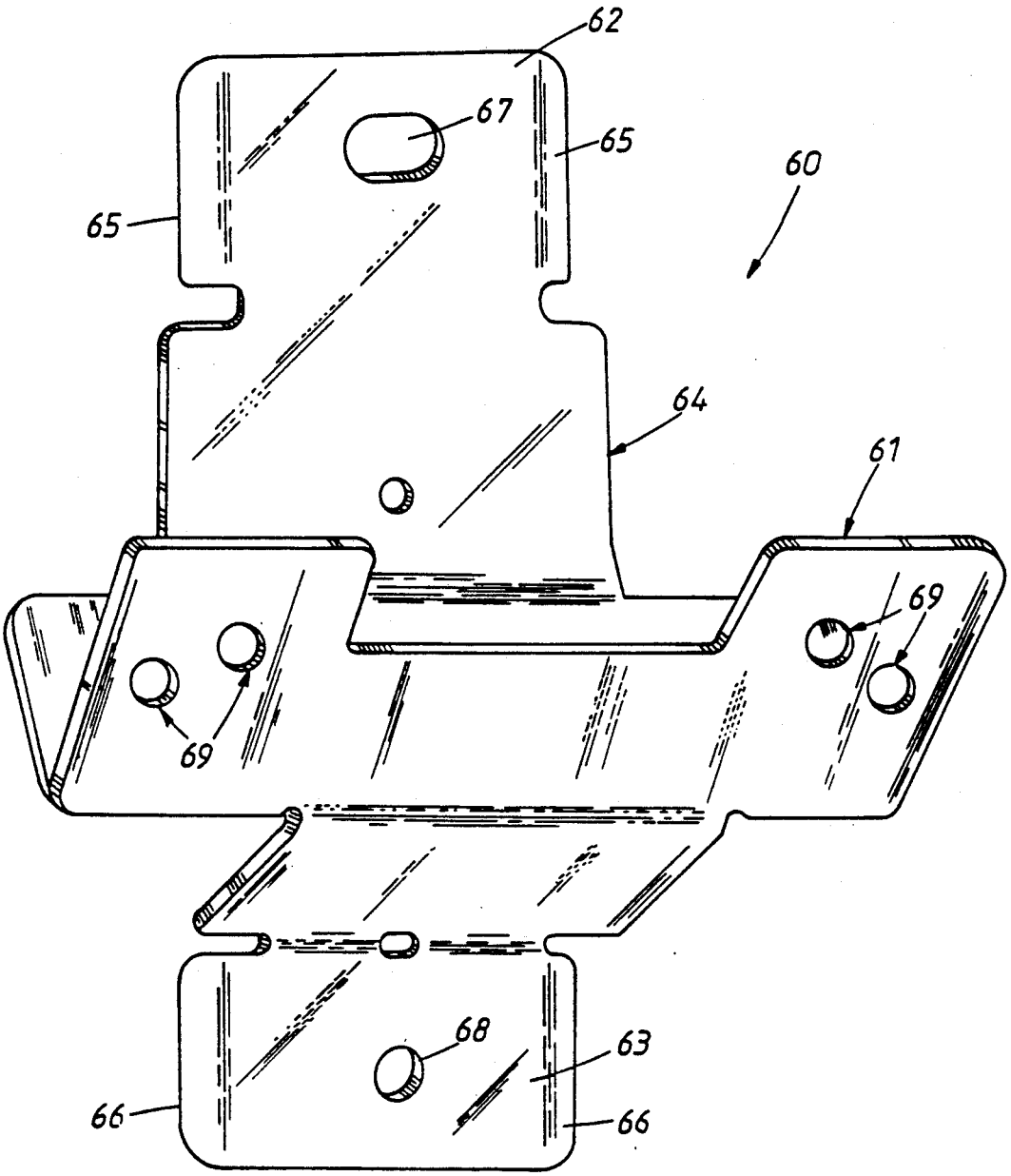
FIG. 9 is a front perspective view of a third embodiment of the mounting bracket.
Figure 12:
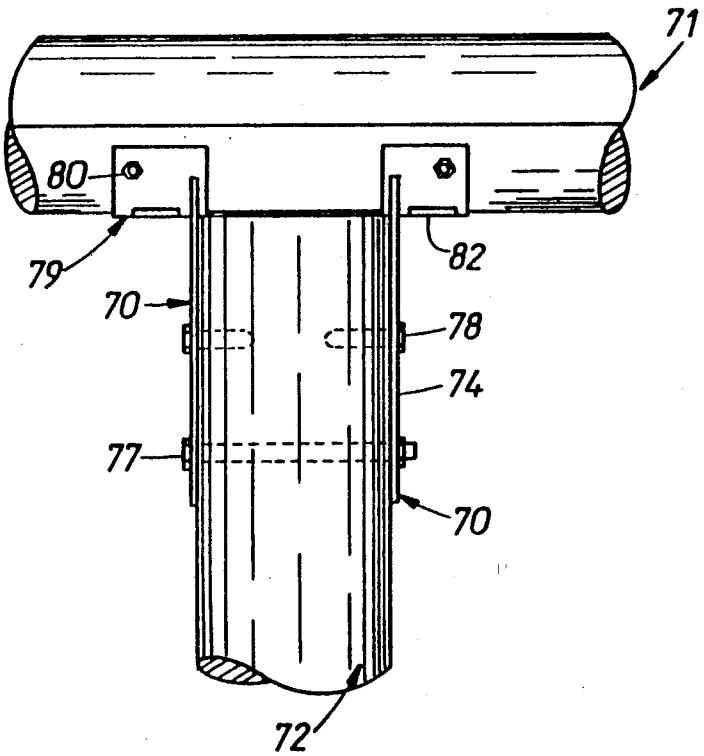
FIG. 12 is a front elevational view showing two of the brackets of FIGS. 10 and 11 mounting a cross-arm on the top of a pole.
Figure 10:
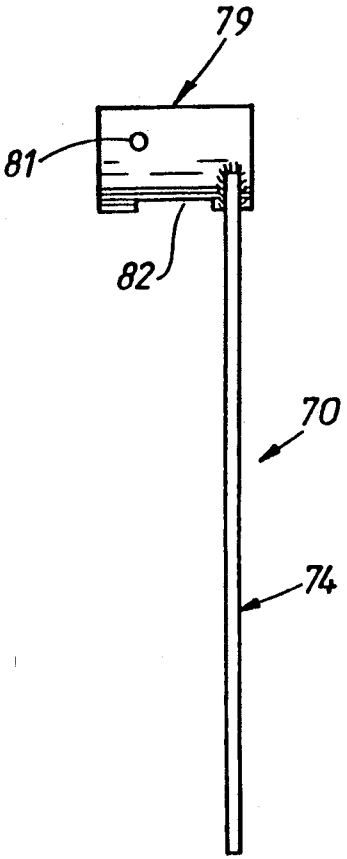
FIGS. 10 and 11 are respective front and side elevational views of a fourth embodiment of the mounting bracket.
Figure 11:
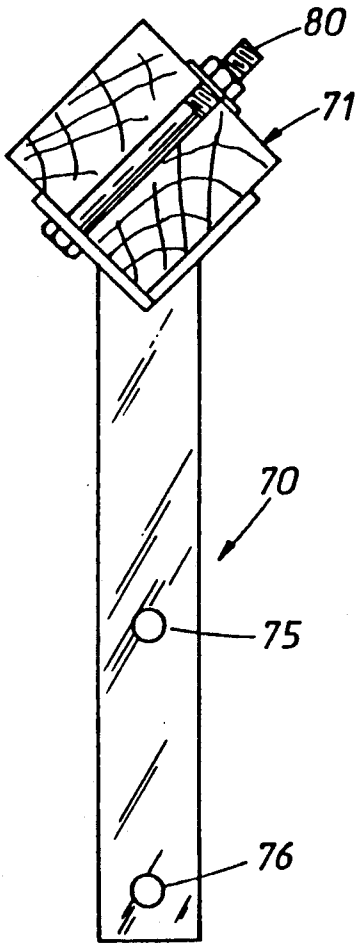
Figure 13:
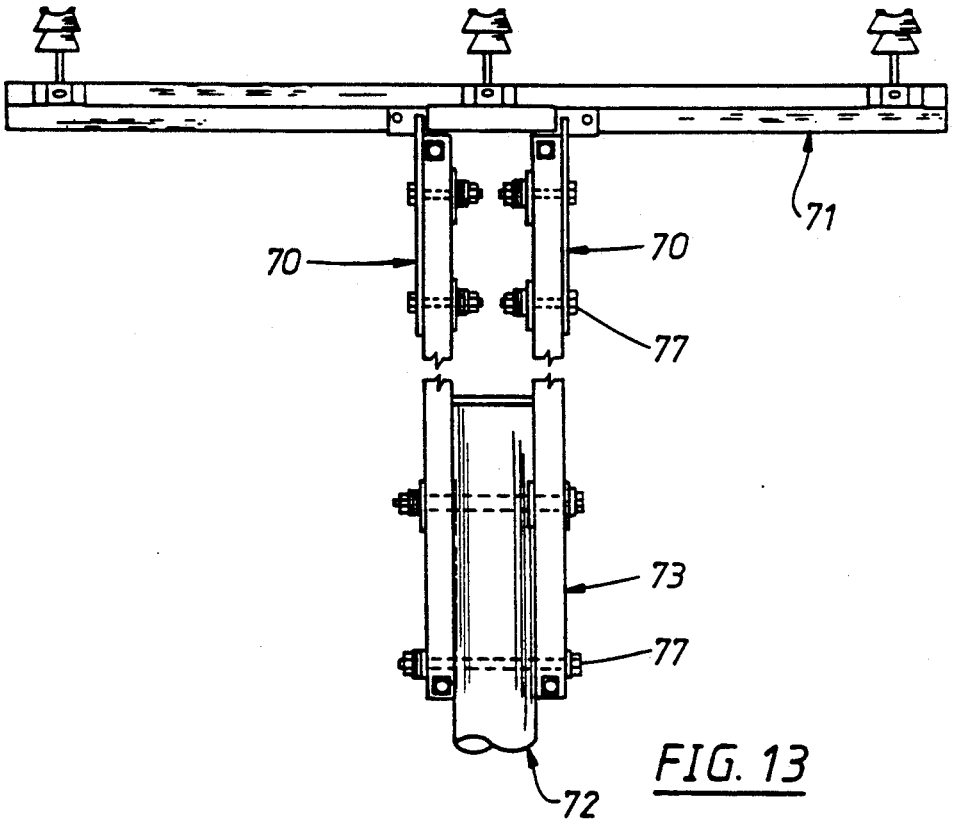
FIG. 13 is a similar view with the cross-arm mounted on extensions on the pole.

The mounting bracket 60 of a third embodiment, in FIG. 9, has its V-shaped cradle 61 formed intermediately of the upper and lower portions 62, 63 of the base plate 64. The base plate 64 is substantially planar and has rearwardly directed flanges 65, 66 to assist in the location of the bracket 60 on the pole. The bracket 60 may be fixed to the pole by bolts or coach screws (not shown) through the holes 67, 68 in the base plate 64, and the cross-arm secured by bolts or coach screws through the holes 69 in the front of the cradle 61.

Figure 23:
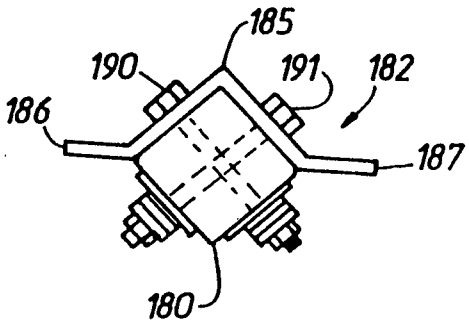
FIG. 23 is an end elevational view of a support bracket for the shackles.

The fourth embodiment of the mounting bracket 70, FIGS. 10 to 13, is designed to support the cross-arm 71 above the top of the pole 72 (see FIG. 12) or at the top of a pair of extension pieces 73, diagonally opposed, at the top of the pole 72 (see FIG. 23).

The bracket 70 has a planar base plate 74, with holes 75, 76 to enable it to be fixed to the pole 72 or extension pieces 73 by bolts 77 or coach screws 78.

The cross-arm 71 is supported in a V-shaped cradle 79 at the top of the base plate 74 and is secured by a bolt or screw 80 through a hole 81 in the cradle 79. An elongate slot 82 along a portion of the bottom of the cradle 79 allows any water which runs into the cradle to drain away and thereby reduce the likelihood of rot in the lower portion of the cross-arm 71.

Figure 14:
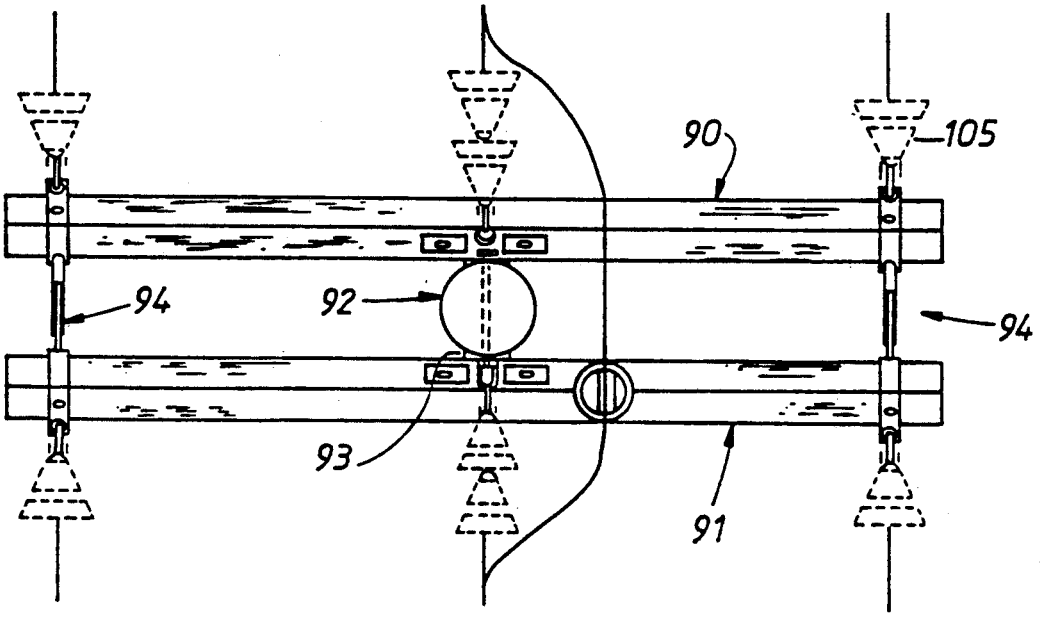
FIG. 14 is a top plan view of an installation with parallel cross-arms on a pole.

In certain installations, the electricity authorities may require the provision of a pair of cross-arms in parallel on the pole and a top plan view of a typical installation is shown in FIG. 14.

Figure 15:
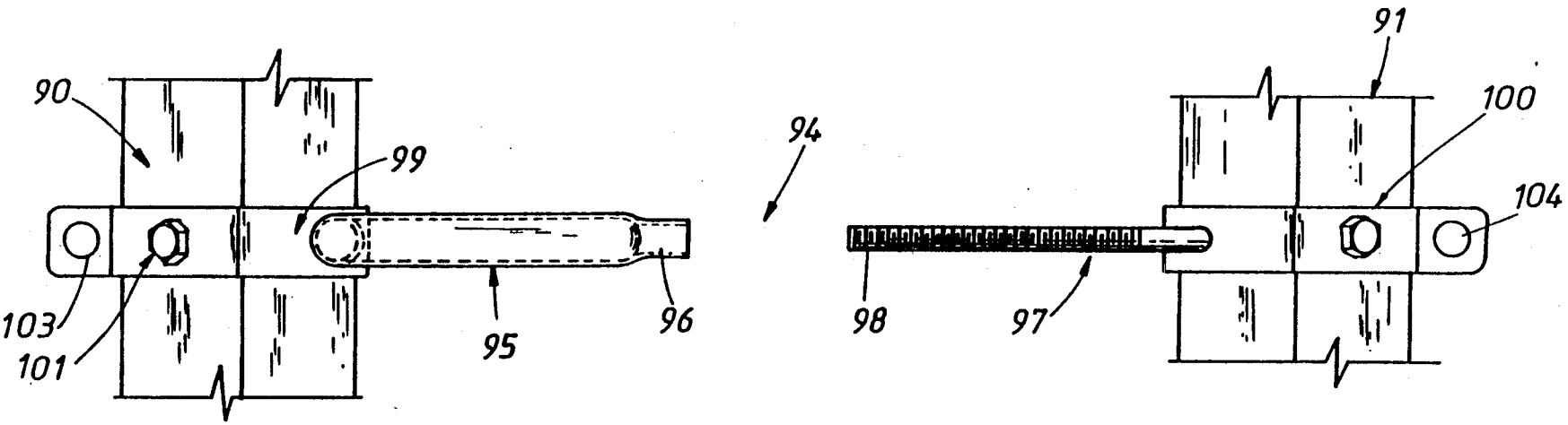
FIGS. 15 and 16 are respective top plan and side sectional views of the links to interconnect the parallel cross-arms on the pole.
Figure 16:
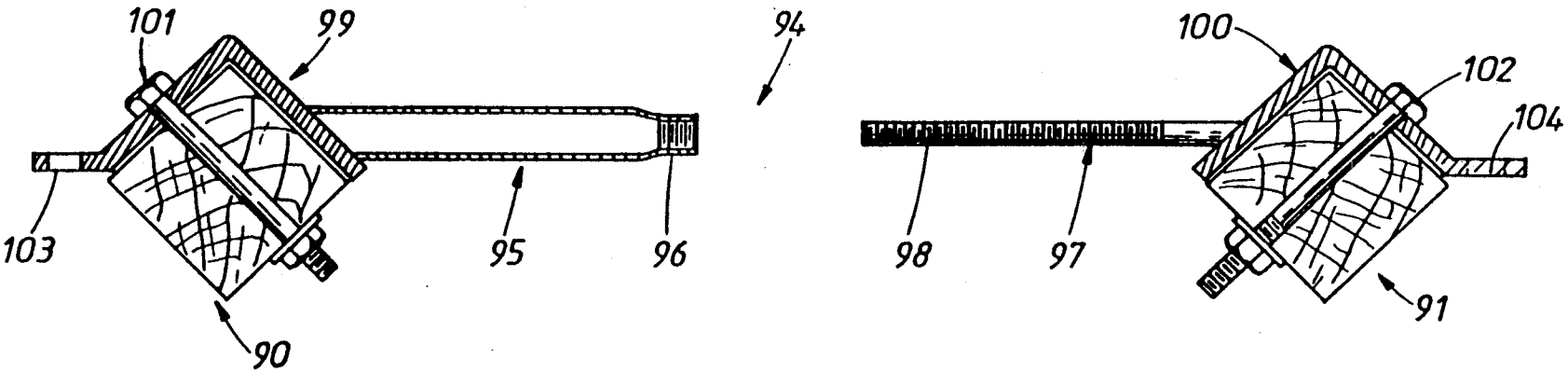

Parallel cross-arms 90, 91 are mounted in parallel on opposite sides of the pole 92 via respective mounting brackets 93 (of the types hereinbefore described). The cross-arms are parallel in plan view and are mounted at the same horizontal level. To provide stability, and to share the loads between the cross-arms, link assemblies 94, described in more detail with reference to FIGS. 15 and 16 may be used.

Each link assembly 94 has a "female" tube 95, with a screw-threaded end 96 and a complimentary screw-threaded end 98, enabling them to be adjustably connected together. The tube 95 and rod 97 have respective inverted V-shaped caps 99, 100 which are secured to the cross-arms 90, 91 respectively, by bolts 101, 102. (For greater strength, the caps 99, 100 may be of double width and provided with two bolts or screws).

Holes 103, 104 in the ends of the caps 99, 100 enable pin-type insulators 14, or shackle-type insulators 105 (see FIG. 14) to be secured on the caps.

While all of the mounting brackets hereinbefore described have been shown in use with timber cross-arms, they may also be used with cross-arms constructed of plywood, synthetic plastics (including fibre-reinforced plastics), and/or concrete. The synthetic plastics cross-arms may have their insulators formed integrally therein.

Various embodiments of insulators suitable for use with the cross-arms and mounting brackets will now be described.

Referring back to FIG. 6, a first embodiment of a pin-type insulator assembly 110 has an insulator head 111 screw-threadably mounted on top of a vertical pin 112. A pair of clamping straps 113 are welded to the pin 112 and are clamped about the cross-arm 41 by a bolt 114. This type of insulator avoids the need to drill the cross-arm.

A second embodiment of a pin-type insulator assembly 120, has the insulator head 121 on a pin 122, which extends through a hole drilled vertically through the cross-arm 41 and the ingress of water is prevented by a water cap 123, of inverted V-section, welded to the pin. A nut 124 screws the pin to the cross-arm 41.

Figure 17:
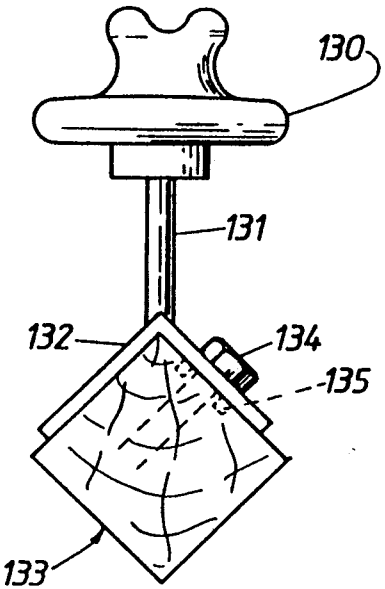
FIG. 17 is a side elevational view of a third embodiment of the insulators and pin.

FIG. 17 shows a third embodiment of a pin-type insulator assembly 130, where the pin 131 is welded to an inverted V-section cap 132 and the latter is secured to the cross-arm 133 by a coach screw 134 (or bolt) through one side of the cap. An O-ring 135 may be provided to seal the cap to the cross-arm about the coach screw.

Figure 18:
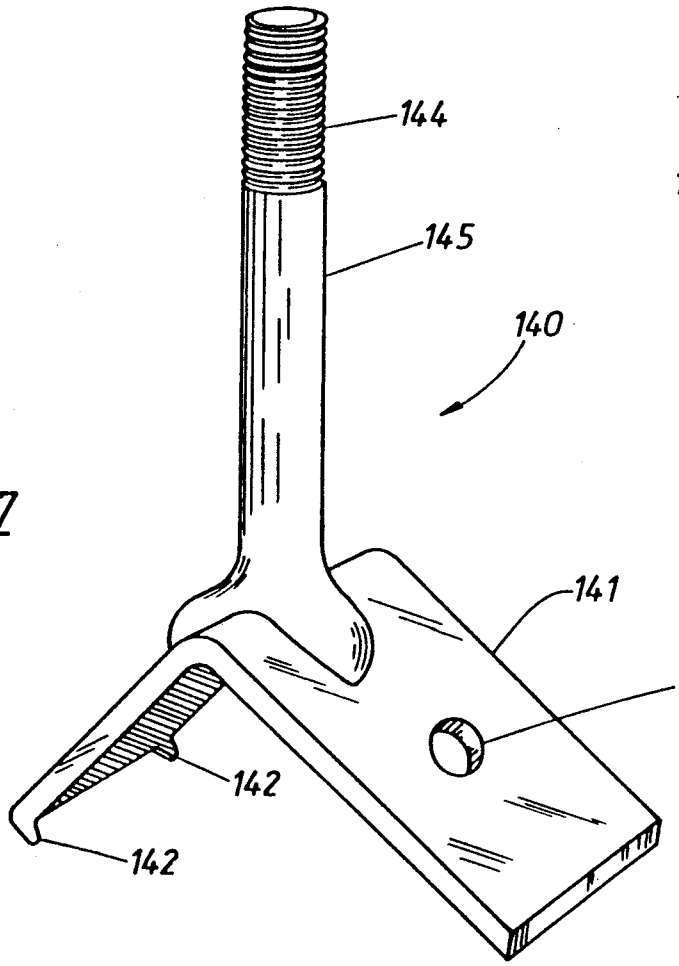
FIG. 18 is a perspective view of a fourth embodiment of an insulator pin (suitable for the bracket of FIG. 9)

The fourth embodiment of the insulator pin 140 in FIG. 18 is similar to the insulator assembly 130 but its cap 141 is provided with integral teeth 142 which bite into the cross-arm when the cap is secured by a bolt or stud passing through the hole 143 in the cap. The ceramic insulating head is screw-threadably mounted on the screw-threaded top portion 144 of the pin 145.

Figure 19:
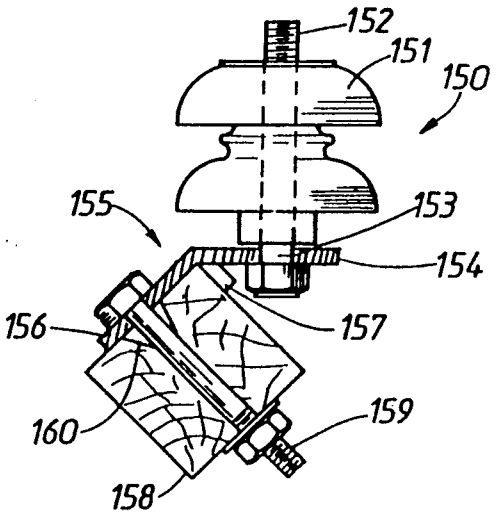
FIG. 19 is an end elevational view of a fifth embodiment of the insulator mounts.

Insulator mount 150 of the fifth embodiment (FIG. 19) has its ceramic insulating head 151 screw-threadably secured on a bolt 152 passing through a hole 153 in a horizontal plate 154 formed integrally with, or welded to, an inverted V-shaped cap 155 (with legs 156, 157). As shown, the cap 155 is secured to the cross-arm 158 by a bolt 159.

For improved weather protection, the hole through the cross-arm 158 may have a conical taper to receive a conical sealing washer 160 which is compressed when the bolt 159 is tightened.

Figure 21:
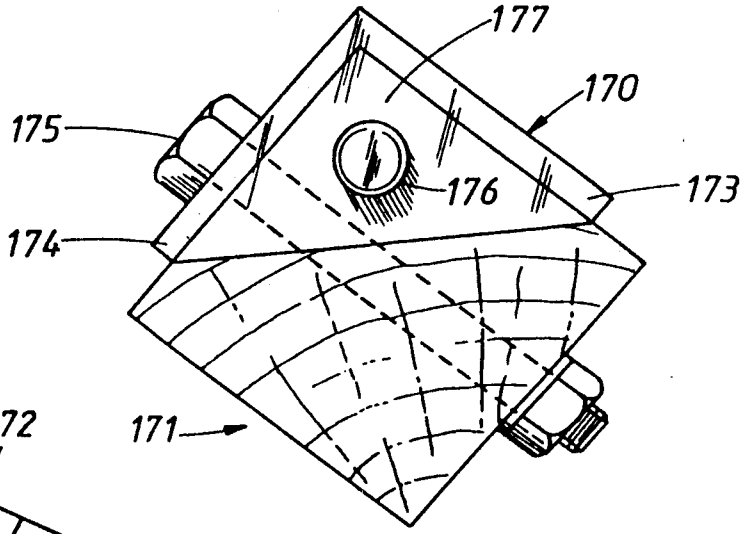
FIGS. 20 and 21 are respective isometric and end elevational views of a sixth embodiment of the insulator mounts suitable for the brackets of FIGS. 6 to 11.
Figure 20:
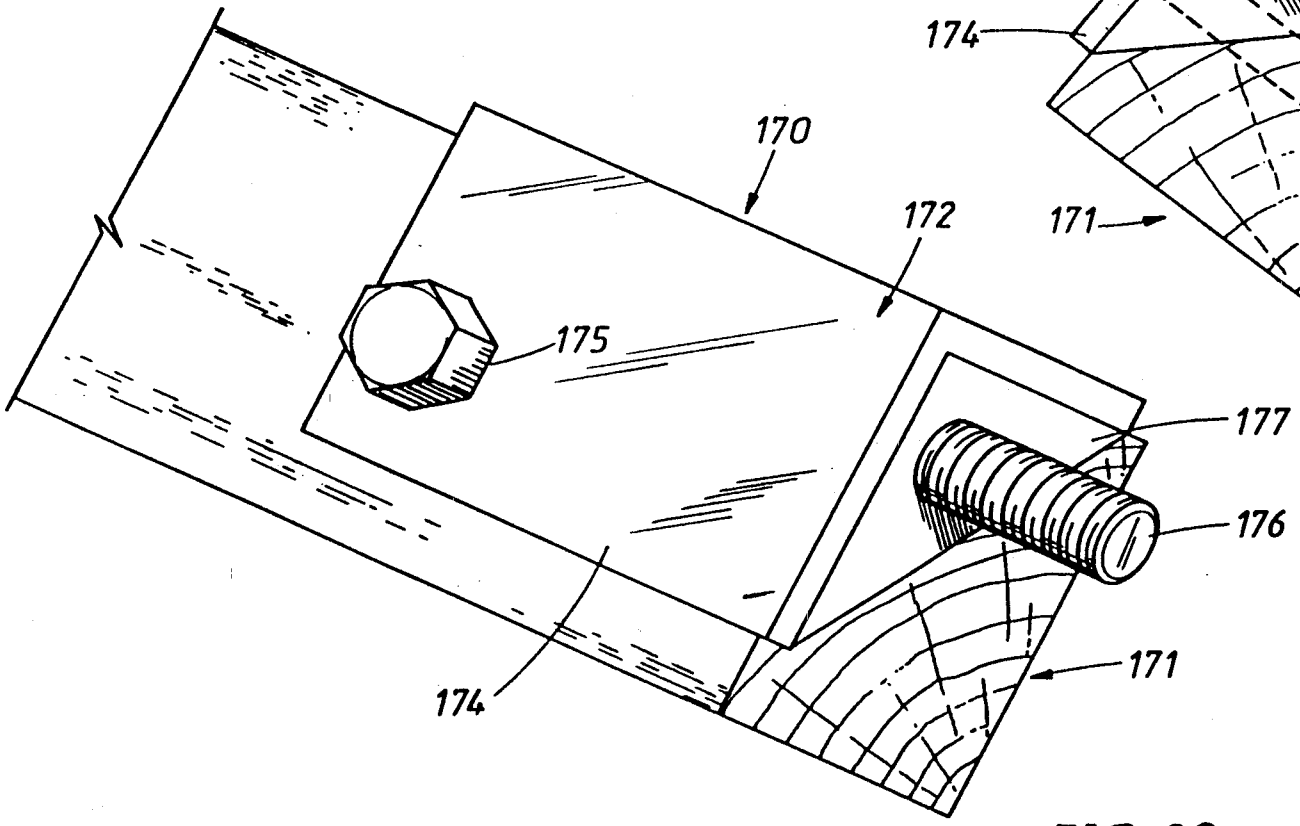

The pin-type insulators hereinbefore described are arranged to support the electricity (or telephone) lines above the cross-arm. The insulator mount 170 of the sixth embodiment (FIGS. 20 and 21) can be used where the lines are to be supported at the ends of the cross-arm 171. (The ceramic insulator heads extend substantially horizontally from the ends of the cross-arm.) The insulator 170 has an inverted V-shaped cap 172, with legs 173, 174, the latter receiving a bolt 175 which secures the cap to the cross-arm. The screw-threaded pin 176 (on which the insulator head is mounted) extends horizontally from a triangular (or square) vertical end plate 177 on the cap.

As previously shown in FIG. 14, the cross-arms and mounting brackets may also be used with shackle-type insulators 105, e.g. on high voltage distribution lines.

Figure 22:
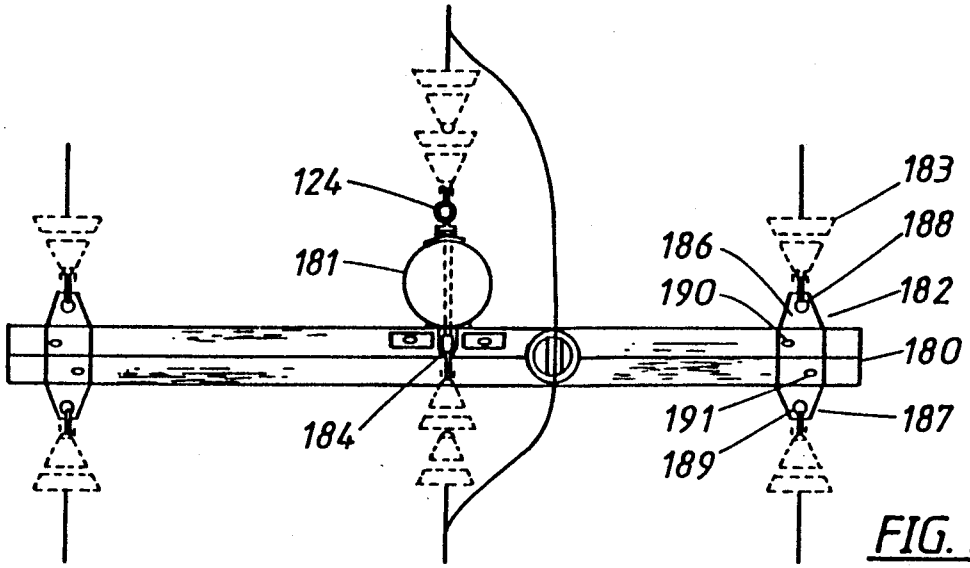
FIG. 22 is a top plan view of a typical installation where shackle-type insulators extend substantially horizontally from the cross-arm.

Referring to FIGS. 22 and 23, the cross-arm 180, mounted on pole 181, is provided with a pair of support brackets 182, each of which supports a pair of shackle-type insulators 183. (The central line is supported by insulators 183 attached to support rings 184 on the pole).

Each support bracket 182 has an inverted V-shaped cap section 185 with horizontal tabs 186, 187 provided with respective holes 188, 189 to which the insulators 183 are secured. Bolts 190, 191 pass through offset holes in the cap section to secure the bracket to the cross-arm 180.

Figure 26:
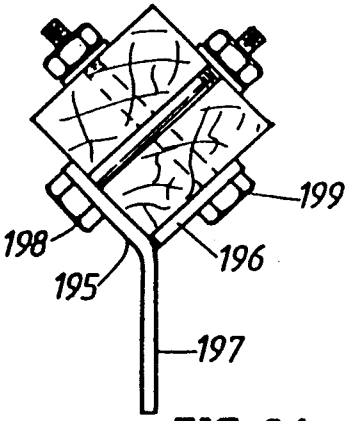
FIG. 26 is a sectional end view showing the et fixed to the cross-arm.
Figure 25:
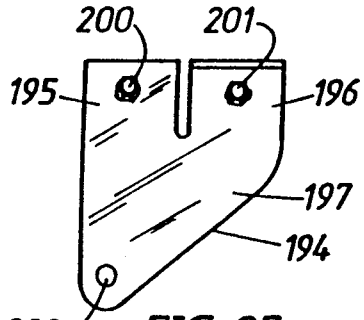
FIG. 25 is a front elevational view of the suspension bracket for the shackles.
Figure 24:
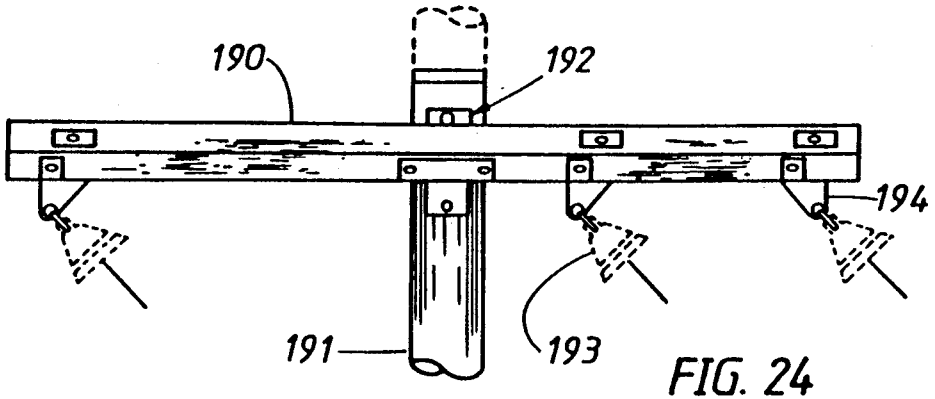
FIG. 24 is a front elevational view of a typical installation where shackle-type insulators are suspended from the cross-arm.

FIGS. 24 to 26 show an alternative embodiment for the shackle-type insulators. As before, the cross-arm 190 is mounted on the pole 191 via a mounting bracket 192 of the types hereinbefore described.

The shackle-type insulators 193 are suspended from suspension bracket 194 shown in more detail in FIGS. 25 and 26.

Each suspension bracket 194 is formed (e.g. in a brake press) from a single sheet of metal and has a pair of inclined arms 195, 196 and a vertical leg 197 so that the bracket 194 is substantially Y-shaped in end view (see FIG. 26). Bolts 198, 199 pass through respective holes 200, 201 to attach the bracket 194 to the underside of the cross-arm 190. The insulator 193 is secured to the brackets 194 via hole 202 in the leg 197.

It will be readily apparent to the skilled addressee that the mounting of the cross-arms 10 (see FIG. 1) on the "diagonal", i.e. with its upper faces 17, 18 downwardly inclined at approximately 45° will enable any rain to run off the cross-arm and wash off any dust and pollution which may have collected thereon. In the embodiment of FIGS. 6 and 7, the mounting bracket 30 does not require the drilling of any holes in the cross-arm which would reduce the strength of the latter. While such holes are required in the embodiments of FIGS. 8, 13, as the holes are on the underside of the cross-arms, there is less chance of the ingress of water into the cross-arms which could cause the cross-arms to rot or decay.

Various changes and modifications may be made to the embodiments described and illustrated without departing from the scope of the present invention defined in the appended claims

I claim:

1. A bracket for mounting a cross-arm on a utility pole, comprising a substantially vertical base plate mountable on the pole, means for fastening the base plate to the pole, a substantially V-shaped cradle affixed to the base plate to receive and support the cross-arm so that neither side of the V-shaped cradle is substantially horizontal, and a pair of straps affixed to the cradle, whereby the straps may be passed over the cross-arm to secure the cross-arm in the cradle.

2. A mounting bracket according to claim 1, wherein the base plate has a back face facing the pole, with side flanges extending rearwardly therefrom, to locate the base plate on the pole.

3. A mounting bracket according to claim 1, wherein the base plate has an upper end, and the fastening means comprises at least one bolt connecting the upper end of the base plate to the pole.

4. A mounting bracket according to claim 1, wherein the cradle extends horizontally, transverse to the base plate.

5. A mounting bracket according to claim 1, wherein the cradle is formed integrally with the base plate and extends horizontally and transverse to the base plate between upper and lower ends of the base plate.

6. A bracket for mounting a cross-arm on a utility pole, comprising a substantially vertical base plate mountable on the pole, means for fastening the base plate to the pole, a substantially V-shaped cradle affixed to the base plate to receive and support the cross-arm so that neither side of the V-shaped cradle is substantially horizontal, and at least one bolt which can be passed through both the cradle and the cross-arm to secure the cross-arm in the cradle.

7. A mounting bracket according to claim 6, wherein the base plate has a back face facing the pole, with side flanges extending rearwardly therefrom, to locate the base plate on the pole.

8. A mounting bracket according to claim 6, wherein the base plate has an upper end, and the fastening means comprises at least one bolt connecting the upper end of the base plate to the pole.

9. A mounting bracket according to claim 6, wherein the cradle extends horizontally, transverse to the base plate.

10. A mounting bracket according to claim 6, wherein the cradle is formed integrally with the base plate and extends horizontally and transverse to the base plate between upper and lower ends of the base plate.

11. A utility structure comprising, in combination, a utility pole, a pair of mounting brackets affixed to the pole, on opposite sides thereof, and a pair of substantially parallel cross-arms supported by the mounting bracket, each said mounting bracket comprising a substantially vertical base plate mountable on the pole, means for fastening the base plate to the pole, a substantially V-shaped cradle affixed to the base plate to receive and support the cross-arm so that neither side V-shaped is substantially horizontal, and means on the cradle for receiving a fastener to secure the cross-arm in the cradle, and further comprising at least one link assembly interconnecting the cross-arms adjacent the ends thereof to provide stability, each link assembly having a female member attached to one of the cross-arms, and a male member attached to the other of the cross-arms, the male and female members being interconnected by a threaded adjuster.

12. A utility structure according to claim 11, further comprising at least one electrical insulator affixed thereto, for supporting utility lines.

13. A utility structure comprising, in combination, a utility pole, a mounting bracket affixed to the pole, and a cross-arm supported by the mounting bracket, said mounting bracket comprising a substantially vertical base plate mountable on the pole, means for fastening the base plate to the pole, a substantially V-shaped cradle affixed to the base plate to receive and support the cross-arm so that neither side of the V-shaped cradle is substantially horizontal, and means on the cradle for receiving a fastener to secure the cross-arm in the cradle, and further comprising at least one electrical insulator mounted on the cross-arm, for supporting utility lines.

14. A utility structure according to claim 13, further comprising a clamp for attaching the insulator to the cross-arm.

15. A utility structure according to claim 14, wherein the clamp comprises a V-shaped cap engaging two adjacent faces of the cross-arm.

16. A utility structure according to claim 15, further comprising a threaded fastener passing through both the cross-arm and the clamp.

17. A utility structure according to claim 15, wherein said cap has integral teeth which engage the cross-arm to locate the cap thereon.

* * * * *